US006448713B1

(12) United States Patent
Farkas et al.

(10) Patent No.: US 6,448,713 B1
(45) Date of Patent: Sep. 10, 2002

(54) SENSING AND CONTROL FOR DIMMABLE ELECTRONIC BALLAST

(75) Inventors: Thomas Farkas, Marlborough, MA (US); Naresh Kesavan Rao, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/731,000

(22) Filed: Dec. 7, 2000

(51) Int. Cl.[7] ..... H05B 37/02

(52) U.S. Cl. ..... 315/DIG. 4; 315/200 R; 315/360

(58) Field of Search ..... 315/200 R, 246, 315/291, 307, 360, DIG. 4, DIG. 7, 224, 225

(56) References Cited

U.S. PATENT DOCUMENTS 5,198,726 A * 3/1993 Van Meurs et al. ..... 315/224
5,583,402 A * 12/1996 Moisin et al. ..... 315/207
5,604,411 A * 2/1997 Venkitasubrahmanian et al. ..... 315/224
5,650,694 A * 7/1997 Jayaraman et al. ..... 307/157
5,965,985 A 10/1999 Nerone ..... 315/DIG. 4
5,982,110 A * 11/1999 Gradzki ..... 315/247
6,300,725 B1 * 10/2001 Zinkler et al. ..... 315/224

* cited by examiner

*Primary Examiner*—Don Wong
*Assistant Examiner*—Thuy Vinh Tran
(74) *Attorney, Agent, or Firm*—Toan P. Vo; Noreen C. Johnson

(57) ABSTRACT

A sensing circuit for a triac dimmable gas discharge lamp ballast uses the duty cycle of the output waveform of a conventional triac dimmer as the parameter representing a set point for controlling the degree of clamping applied to the ballast circuit, and thus the amount of light produced by a fluorescent lamp. The sensing circuit may include a comparator that receives a rectified output waveform of a triac dimmer and produces output pulses corresponding in width to the duty cycle of the waveform, and a capacitor averaging the values of the pulses produced by the comparator to produce a set point signal representing a dimming level of the lamp. A triac dimmable ballast circuit using this sensing circuit has reduced sensitivity to line voltage and a wide mechanical range over which the light level of the fluorescent lamp is controlled by the user. The sensing circuit also enables a preheat timing circuit that eliminates the timing capacitor of prior art preheating circuits. A gas discharge lamp ballast and a method for its operation are also disclosed.

20 Claims, 10 Drawing Sheets

SENSING AND CONTROL FOR DIMMABLE ELECTRONIC BALLAST

FIELD OF THE INVENTION

The invention pertains to a ballast for a compact gas discharge lamp, and more particularly to a ballast that is dimmable in accordance with a user setting of a standard dimmer switch.

BACKGROUND OF THE INVENTION

Gas discharge lamps such as fluorescent lamps produce light by exciting a gas with a high voltage a.c. signal generated by the drive section of a ballast circuit. The intensity of illumination is determined by the power of the excitation signal, which in turn depends on the signal frequency.

A ballast circuit for a gas discharge lamp is illustrated in U.S. Pat. No. 5,965,985, which issued to Nerone and is commonly assigned to the owner of the present application. U.S. Pat. No. 5,965,985 is incorporated herein by reference in its entirety. FIG. 1 shows Nerone's ballast circuit 10. A gas discharge lamp 12 is powered from a d.c. bus voltage between d.c. bus 16 and reference bus 18 that is converted to a.c. Switches 20 and 22 are serially connected between buses 16 and 18 in the form of a complementary converter circuit. The switches comprise n-channel and p-channel enhancement mode MOSFETs connected in a common source arrangement at a common node 24. The switches may alternatively comprise other devices having complementary conduction modes, such as PNP and NPN bipolar junction transistors.

A resonant load circuit 25 including a resonant inductor 26a and a resonant capacitor 28 receives current through the common node 24. Circuit 25 includes a d.c. blocking capacitor 30 and a snubber capacitor 32. Lamp 12 includes resistively heated cathodes 12a and 12b that are supplied with heating current by windings 26c and 26d mutually coupled to inductor 26a. Switches 20 and 22 cooperate to provide a.c. current from the common node 24 to resonant inductor 26a.

The gate electrodes 20a and 22a of the switches are connected at a control node 34. Gate drive circuitry, generally designated 36, is connected between control node 34 and common node 24, and implements regenerative control of switches 20 and 22. A drive winding 26b is mutually coupled to resonant inductor 26a, which carries a voltage proportional to the instantaneous rate of change of current in load circuit 25. A transformer winding 38a serially connected to the driving inductor 26b couples a controlled voltage in series with the driving inductor 26b as described below.

A bidirectional voltage clamp 40 comprised of back-to-back Zener diodes cooperates with the transformer winding 38a such that the phase angle between the fundamental frequency component of voltage across resonant load circuit 25 (e.g., from node 24 to node 18) and the a.c. current in resonant inductor 26i a approaches zero during lamp ignition. A capacitor 44 is provided between nodes 24 and 34 to predictably limit the rate of change of control voltage between the nodes. This provides a dead time interval during switching of switches 20 and 22 during which neither switch is turned on.

The frequency of the a.c. signal produced by the ballast is controlled by a clamping circuit 62. FIG. 2 shows details of Nerone's clamping circuit. The clamping circuit controls ballast circuit frequency by varying the loading across the transformer winding 38a by means of a controlled impedance, implemented as a MOSFET 72, in response to an error signal. The error signal is produced by a difference amplifier 64 that receives as input a set point signal provided by a user input potentiometer 68, and a lamp current feedback signal provided by low pass filter 60 of FIG. 1. The low pass filter 60 provides a time-averaged signal derived from a lamp current signal sensed by a sensing resistor 54 and rectified by p-n diode 56. Half cycles of lamp current of the other polarity are shunted across resistor 54 by a diode 58. The error signal provided by the difference amplifier 64 is amplified by an error amplifier 70, powered from a node 73, and applied to the gate of the MOSFET 72. The MOSFET 72 determines the voltage across a control winding 38b, which is mutually coupled to the transformer winding 38a of the driving circuit of FIG. 1.

A diode bridge network 74a–74b enables the MOSFET 72 to conduct current through winding 38b in both directions, e.g., first through diodes 74a, 74b and then through diodes 75a, 75b. A capacitor 78 shunts switch 72 to assist in clamping voltage across the control winding. A voltage clamp 80 such as a Zener diode shunts MOSFET 72 to limit the minimum frequency so as to set a maximum voltage across the lamp during ignition. The lower node of MOSFET 72 comprises the reference bus 18 of FIG. 1, and upper node 73 comprises a power supply node coupled via a resistor (not shown) to the d.c. bus 16 of FIG. 1.

A preheat switch 82, such as a p-channel enhancement mode MOSFET, may be provided to conduct for a preheat timing interval when the ballast circuit is first supplied with d.c. bus voltage. When conducting, switch 82 overrides MOSFET 72 by shorting its output. This allows resistively heated cathodes 12a and 12b of FIG. 1 to reach a desired temperature, while maintaining a low voltage across lamp 12, before lamp ignition. A circuit 84 for controlling the preheat switch 82 may be constructed as shown in FIG. 3. As shown in FIG. 3, a comparator 85 receives a reference voltage from circuit 86 on its negative input, and upon bus energization, receives an increasing voltage on its positive input from a preheat capacitor 88. The capacitor is charged by current conducted from node 73 by a preheat resistor 90. The values of resistor 90 and capacitor 88 determine the duration of the preheat period during which switch 82 of FIG. 2 conducts upon bus energization.

Nerone's ballast circuit thus enables control of the brightness of a fluorescent discharge lamp by means of the user input, which controls the voltage across the clamping transformer winding 38a of the driving circuit, thereby determining the frequency of the a.c. voltage applied to the resonant load circuit and thus controlling the current provided to the gas discharge lamp.

Other prior art devices have attempted to enable dimming of fluorescent lamps by the inexpensive triac-based phase-control dimmers that are commonly used in conjunction with incandescent lighting. In these prior art devices, an average value or peak value of rectified voltage from the triac that is applied to the input of the ballast circuit is taken to represent the set point for controlling clamping. A disadvantage of these devices is that the set point changes substantially with a.c. power source voltage. Due to the characteristics of triac dimmers, sensitivity to line voltage is exacerbated by changes in the phase angle of the dimmer with line voltage variation. Devices that use the peak of the line voltage, or the average value of d.c. bus voltage derived by peak rectifying a.c. line voltage, give a significant response to the user only at phase angles well in excess of 90 degrees, leaving a small mechanical control range within which the user must adjust the dimmer control to achieve a desired light level.

BRIEF SUMMARY OF THE INVENTION

To make energy-efficient compact fluorescent lamps true replacements for incandescent light bulbs, it is desirable for them to be dimmable by conventional triac-based controllers. A key design issue is sensing the setting of the triac dimmer to determine the desired light level while eliminating sensitivity to line voltage. Thus there is a need to provide a triac dimmable ballast circuit with reduced sensitivity to line voltage.

Ideally, the triac-dimmable ballast should sense the mechanical setting of the dimmer control, since this is the information closest to the user. Thus, there is a need to provide the user of the triac dimmer control with a wide mechanical range over which the light level of the fluorescent lamp is controlled by the user.

In general terms, an embodiment of the invention addresses the above needs by using the duty cycle of the output waveform of the conventional triac dimmer as the parameter representing the set point that controls the degree of clamping applied to the ballast circuit, and thus the amount of light produced by the fluorescent lamp.

The invention may be embodied in a sensing circuit for a triac dimmable gas discharge lamp ballast. The sensing circuit may include a comparator receiving a rectified output waveform of a triac dimmer and producing output pulses corresponding in width to the duty cycle of the waveform, and a low pass filter averaging the values of the pulses produced by the comparator to produce a set point signal representing a dimming level of the lamp.

The invention may further be embodied in a dimmable gas discharge lamp ballast. The ballast includes an a.c. to d.c. converter receiving an output waveform of a triac dimmer, a lamp drive section powered by the a.c. to d.c. converter and driving a gas discharge lamp with an ac. signal, a sensing circuit producing a set point signal in accordance with the duty cycle of the output waveform of the triac dimmer, and a clamping circuit controlling clamping of lamp current in response to the set point signal and a lamp current feedback signal.

The invention may be further embodied in a method for controlling a triac dimmable gas discharge lamp ballast. The method may include sensing a duty cycle of a triac dimmer output waveform, producing a set point signal having a value corresponding to the sensed duty cycle, and controlling clamping of lamp current in response to the set point signal and a lamp current feedback signal.

The invention may also be embodied in a preheat timing circuit for a triac dimmable gas discharge lamp ballast. The timing circuit may include a comparator receiving a rectified output waveform of a triac dimmer and producing output pulses, and a timer receiving the output of the comparator and operative of a preheat switch of the gas discharge lamp ballast after receiving a predetermined number of output pulses.

Other aspects of the invention will be apparent to those of ordinary skill in the art from the detailed description and drawings below.

DETAILED DESCRIPTION OF THE INVENTION

Figure 4:
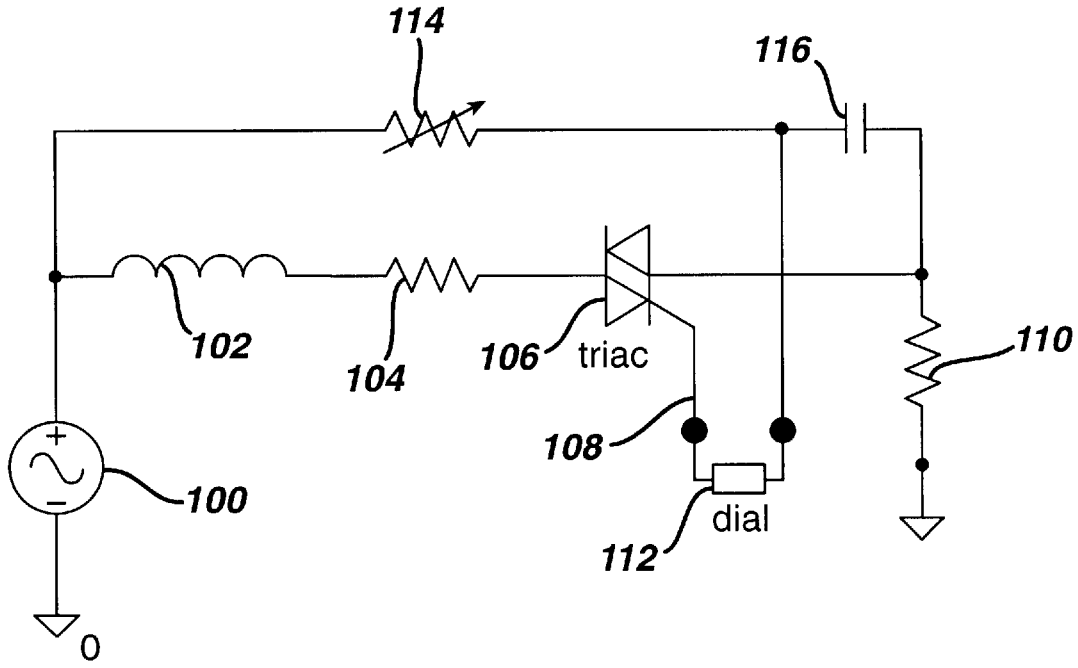
FIG. 4 PRIOR ART
FIG. 4 is a schematic diagram of a conventional triac dimmer circuit.

The objects of the invention are achieved by using the duty cycle of the output waveform of a conventional triac dimmer as the parameter that represents the set point signal for controlling the degree of clamping applied to the ballast circuit, and thus the amount of light output by the fluorescent lamp. FIG. 4 illustrates an example of a conventional triac dimmer circuit, in which an a.c. voltage source 100 drives a load 110, such as an incandescent light bulb or a fluorescent gas discharge lamp ballast, by means of a triac 106 and a filter inductor 102 having an inductor resistance 104. The triac operates to pass any voltage in either direction when triggered by the signal at its control input 108. The control input 108 of the triac 106 receives a signal from a diac 112, which receives at its other terminal a signal from the R-C timer network consisting of a potentiometer 114 and capacitor 116. The diac is a negative impedance device that triggers the triac in accordance with the time constant of the R-C timer network set by the potentiometer.

Figure 5:
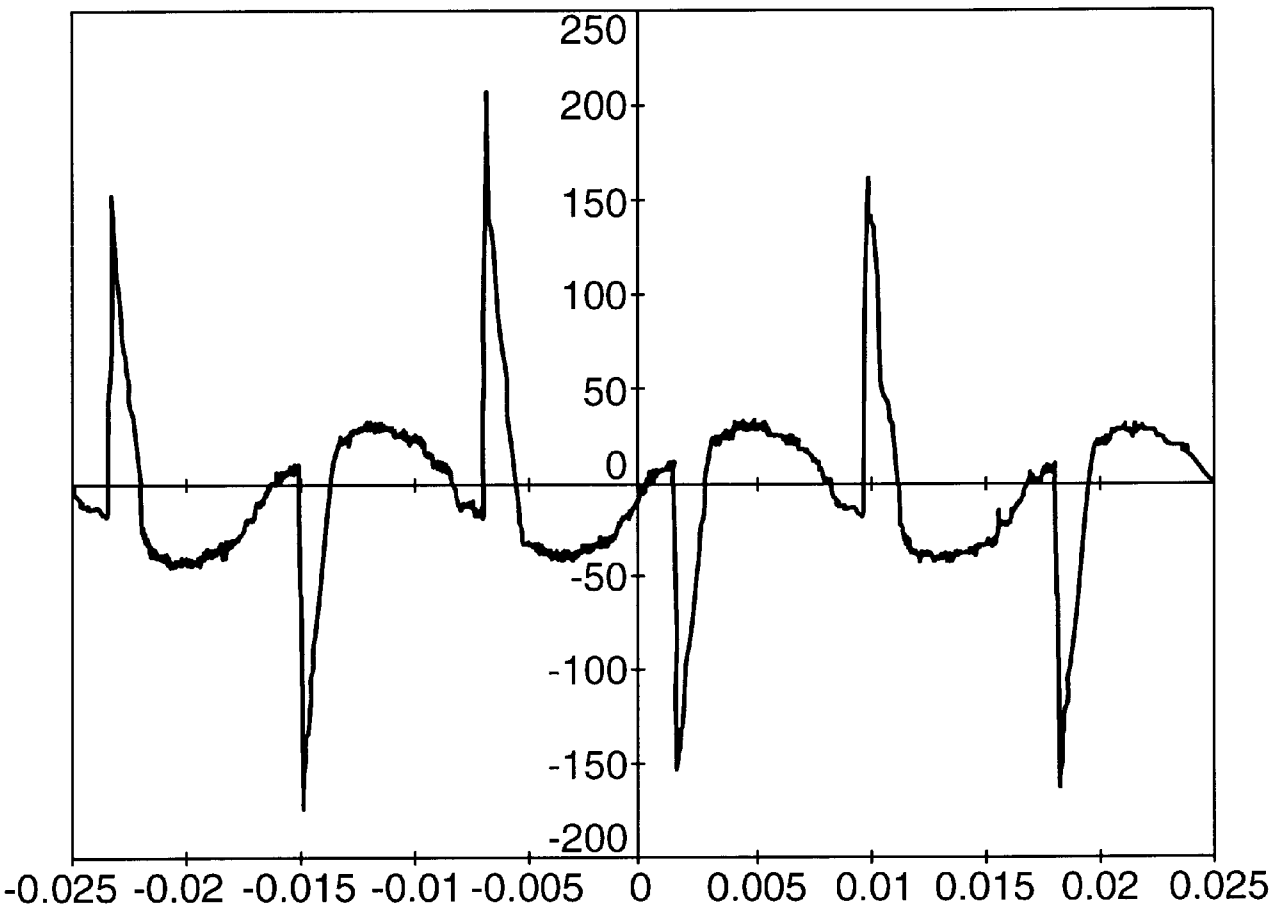
FIG. 5 PRIOR ART
FIGS. 5, 6 and 7 are output waveforms of the conventional triac dimmer circuit of FIG. 4.
Figure 6:
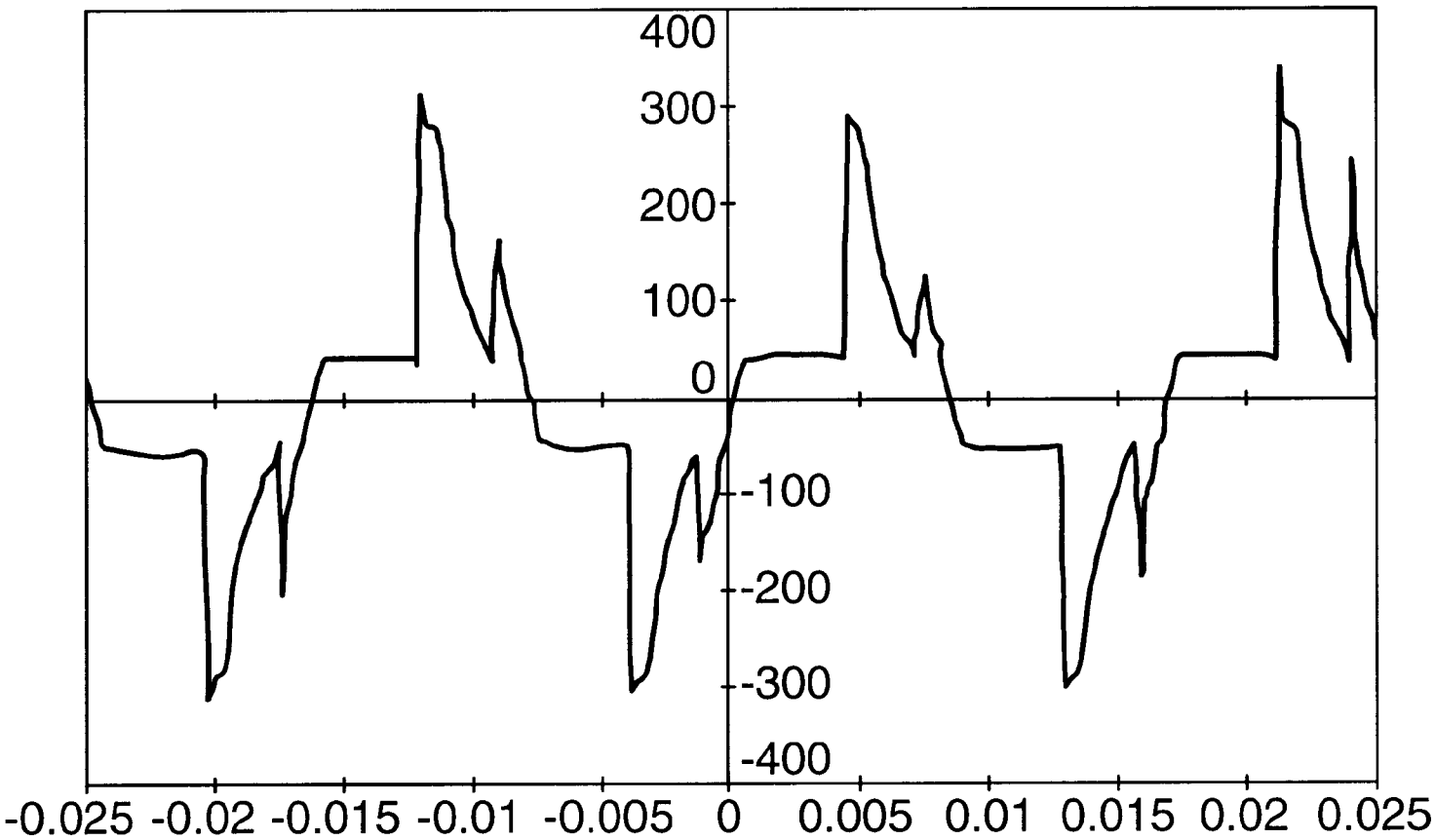
FIG. 6 PRIOR ART
Figure 7:
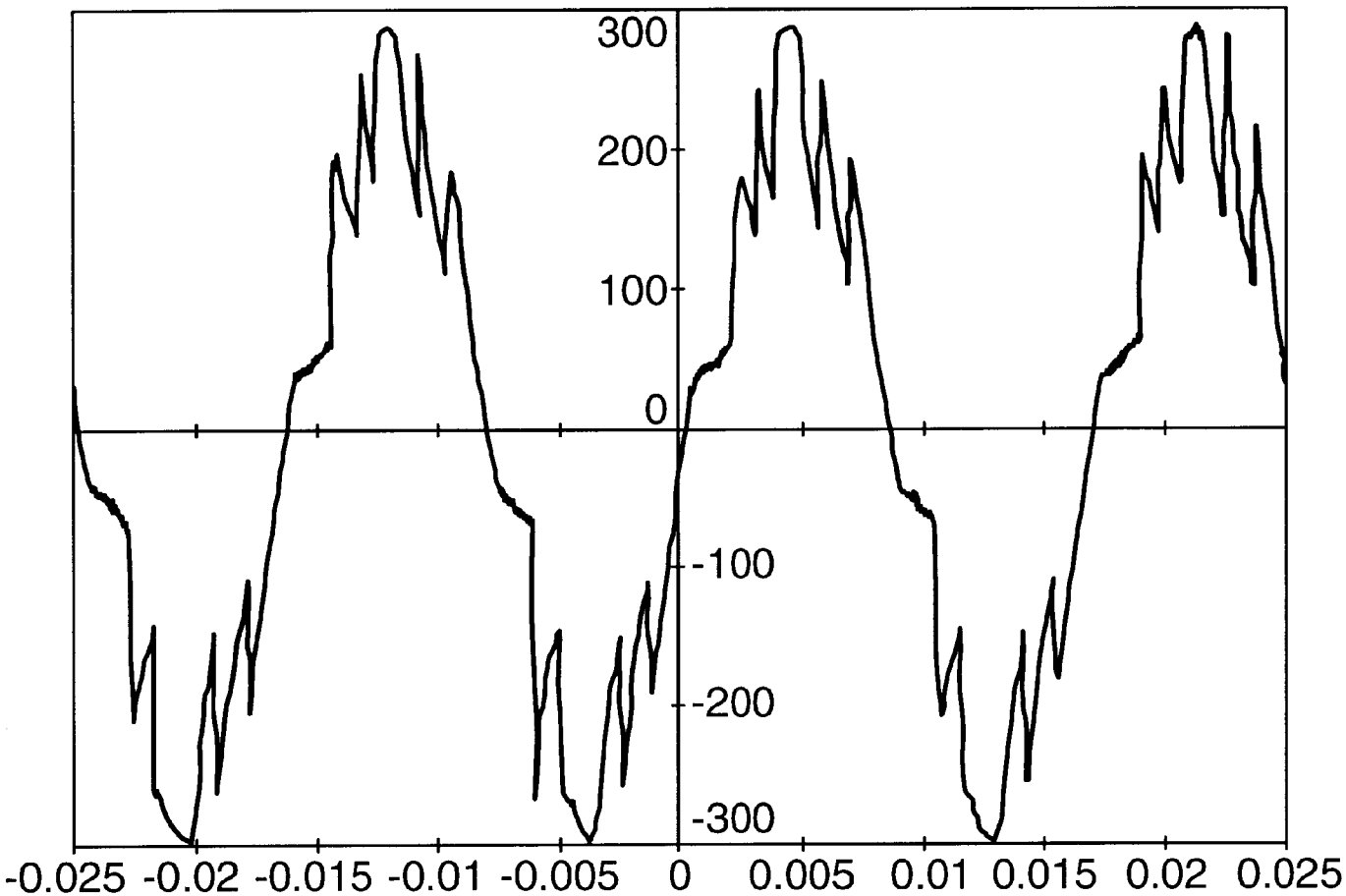
FIG. 7 PRIOR ART

FIGS. 5 through 7 show output voltage waveforms produced by the triac 106 across the load 110 at progressively increasing potentiometer settings. As seen in these figures, the triac output pulses generally increases in width as the potentiometer setting is increased, but the waveform is irregular.

Figure 1:
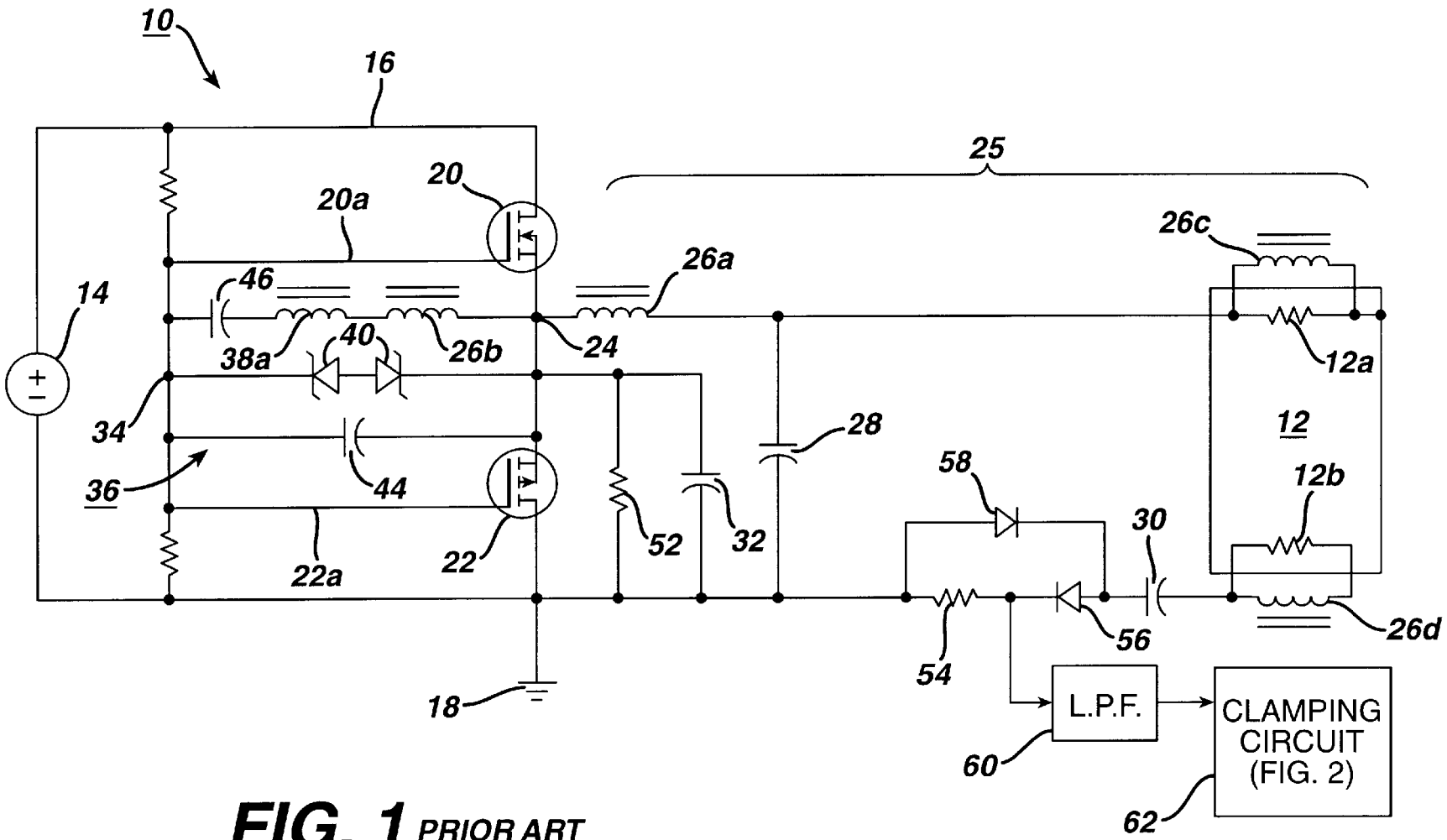
FIG. 1 PRIOR ART
FIG. 1 is a schematic diagram, partially in block form, of a prior art ballast circuit.
Figure 2:
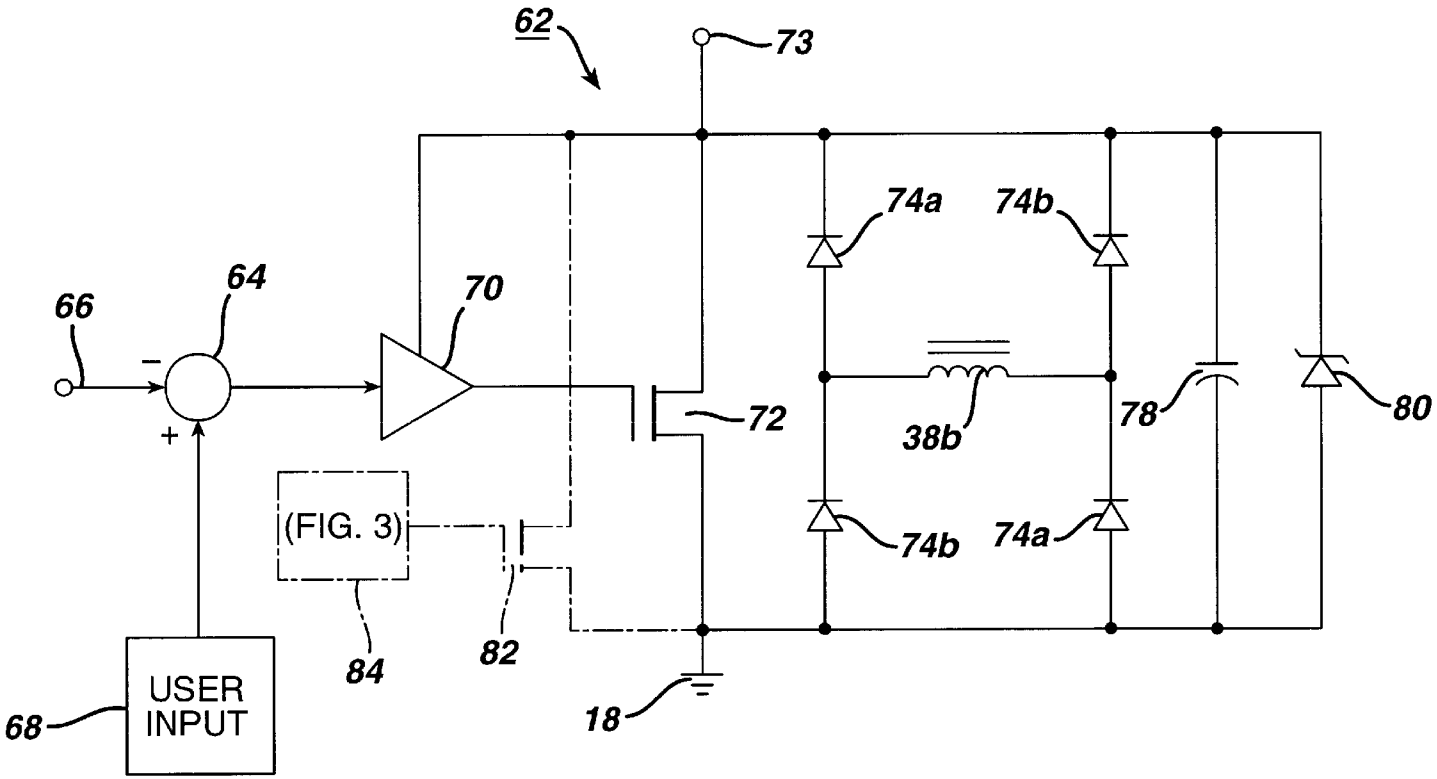
FIG. 2 PRIOR ART
FIG. 2 is a schematic diagram, partially in block form, of the clamping circuit shown in FIG. 1.
Figure 3:
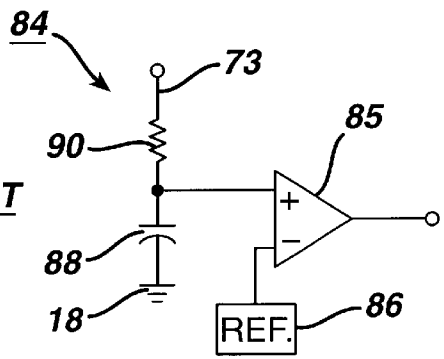
FIG. 3 PRIOR ART
FIG. 3 is a schematic diagram of a timing circuit for a preheat switch of FIG. 2.
Figure 8:
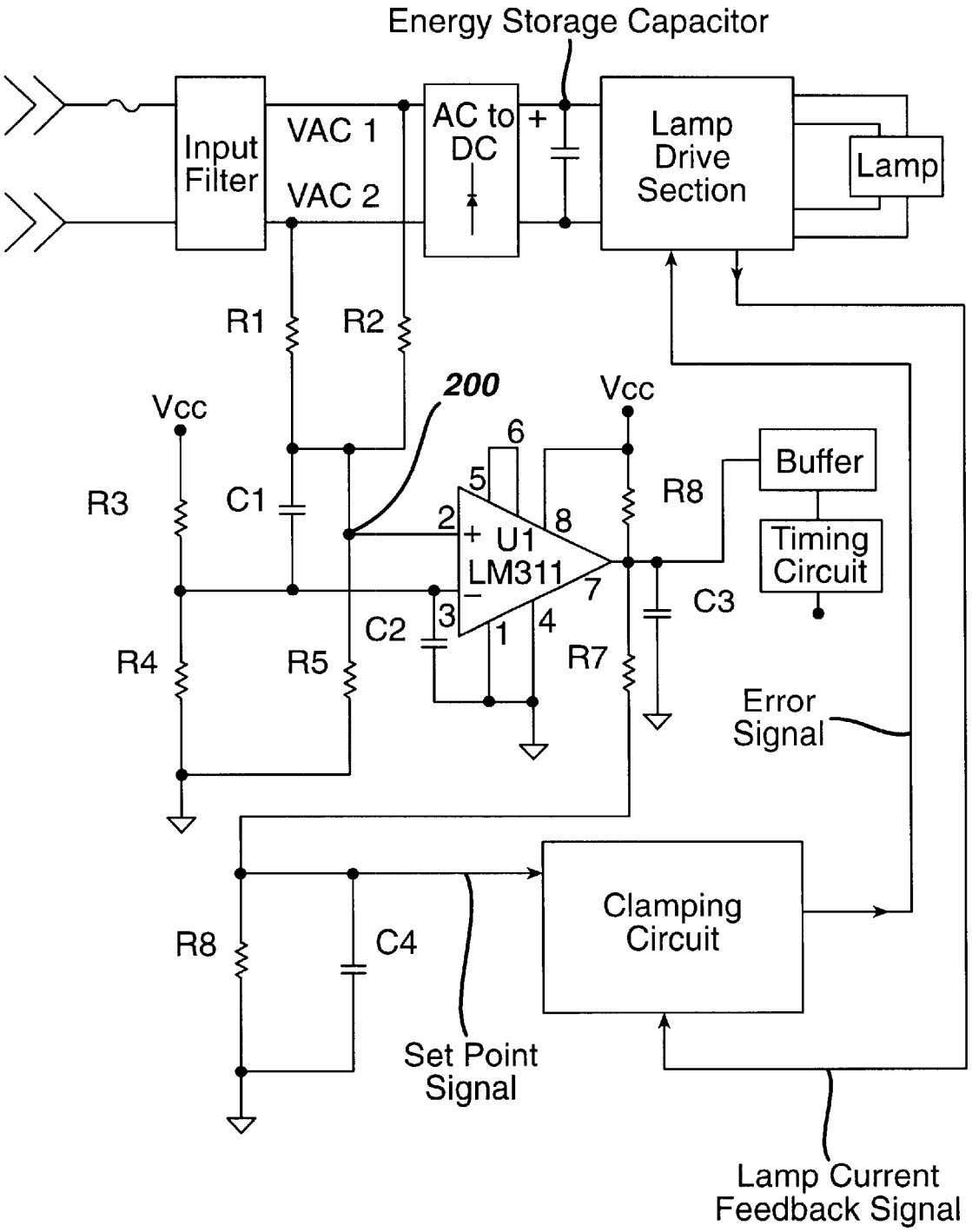
FIG. 8 is a schematic diagram of a preferred embodiment of a sensing circuit in accordance with an embodiment the invention.

FIG. 8 shows a preferred embodiment of a fluorescent lamp device including a sensing circuit in accordance with an embodiment of the invention for controlling dimming of the fluorescent lamp. The fluorescent lamp is driven by the output of a triac dimmer such as the one illustrated in FIG. 4. The lamp device includes an input filter, an a.c. to d.c. converter comprising a bridge rectifier, and a lamp drive section driving a gas discharge lamp. The current that drives the lamp is regulated by a clamping circuit that clamps voltage across a clamping inductor of the lamp circuit in response to a lamp current feedback signal and a set point signal. Examples of lamp drive sections and clamping circuits include those of the prior art device illustrated in FIGS. 1 and 2, and those of the copending application entitled "Improved Self-Oscillating Gas Discharge Lamp Ballast", filed Dec. 6, 2000, which is commonly owned and shares common inventorship with the present application, and which is incorporated herein by reference in its entirety. A clamping circuit in accordance with an embodiment of the copending application includes an inductor that is directly inserted in the lamp driving section. A difference amplifier of the clamping circuit is isolated from the lamp driving section voltages by means of a zener diode inserted between the output of the difference amplifier and the MOSFET switch. This circuit eliminates the bulky mutually coupled inductors employed to couple the clamping circuit and lamp driving section in prior art devices. Those of ordinary skill in the art will recognize that a lamp driving section and clamping circuit in accordance with an embodiment of the invention of the copending application may be used in conjunction with the present invention to provide improved miniaturization of ballast circuit components. Accordingly, it is preferred to use a lamp driving section and clamping circuit in accordance with an embodiment of the invention of the copending application in conjunction with an embodiment of the present invention.

The device further comprises a sensing circuit providing a set point signal to the clamping circuit based on the duty cycle of the triac dimmer output waveform. The sensing circuit generates a signal that has a positive value when the triac dimmer output voltage is above a turn-on threshold, and a zero value when the magnitude of the triac dimmer output voltage falls below a turn-off threshold. The signal thus approximates the duty cycle or "on time" of each triac output pulse. The average value of the signal is used as the set point signal. The lamp current is thereby governed directly by the duty cycle of the triac dimmer.

In the preferred embodiment illustrated in FIG. 8, a summing resistive voltage divider comprised of resistors R1, R2 and R5 receives respective inputs from both sides VAC1 and VAC2 of the filtered AC line voltage to produce a full-wave rectified ballast input voltage in conjunction with the rectifier diode bridge of the a.c. to d.c. converter. Although a simple resistive divider from either side of the AC input line could be used to achieve half-wave sensing, substantial filtering would be necessary to ensure that the resulting line frequency modulation does not cause lamp flicker. Of course, if there were no large energy storage capacitor causing the voltage on the DC side of the a.c. to d.c. converter to remain high as the line voltage falls below the threshold level, then this point could be used for single-point full-wave sensing.

The output of the summing resistive divider at node 200 is received at the positive input of a comparator U1. The negative input of the comparator U1 receives a threshold voltage generated by the voltage divider comprised of resistors R3 and R4. The comparator output is normally low and goes high whenever the rectified input voltage signal exceeds the threshold voltage. The determination of appropriate thresholds is discussed below.

The output of the comparator consists essentially of square pulses having widths that correspond to the widths of corresponding triac output pulses. The output pulses of the comparator are averaged by a low pass filter implemented as a capacitor C3, and the average is provided by means of resistive divider voltage divider R7, R8 as input to the clamping circuit as a set point signal for regulating clamping of the lamp driving current. In operation, this sensing circuit achieves dimming from 100% to less than 10% of light output over a wide mechanical setting range of the dimmer.

Exemplary values for the components illustrated in FIG. 8 are as follows:

| | | | |
|---|---|---|---|
| R1, R2 | 750k | C1 | 510 pF |
| R3 | 470k | C2 | .01 μF |
| R4 | 47k | C3 | 1000 pF |
| R5 | 4.7k | C4 | 0.1 μF, 25 V |

-continued

| | |
|---|---|
| R6 | 100k |
| R7 | 1000k |
| R8 | 560k |

When dimming fluorescent lamps, especially with a triac dimmer, the ballast may need to limit the minimum and/or maximum lamp current levels, and corresponding maximum and minimum dimmer settings beyond which no changes in light level occur ("dead bands"). This function can be implemented by incorporating upper and lower "saturation" limits, and an offset as needed, on the set point voltage.

Referring again to FIGS. 5 through 7, it is seen that the irregular triac output waveform may contain a number of relative peaks within a cycle. Each of the sharp rising edges of the waveforms corresponds to a firing of the triac, and depending on the level of loading provided by the ballast circuit, there may be multiple firings of the triac during each cycle. Accordingly, a turn-on threshold is selected that will only be triggered by the major peak within each cycle. Typical values for the comparator turn-on threshold are 25% to 50% of the nominal peak line voltage. To avoid multiple comparator pulses during each line frequency half-cycle, a turn-off threshold lower than the turn-on threshold is recommended for the comparator phase-angle sensing circuit. For example, referring to the waveform of FIG. 6, it is desirable to lower the threshold of the comparator upon the transition to the first peak of the triac output so that the comparator output does not transition at the subsequent valley and peak of the triac waveform. This is achieved by adding hysteresis to the comparator circuit. Typical values for the comparator turn-off threshold are in the range of 10% of the nominal peak line voltage. Comparator hysteresis may be implemented in the circuit of the preferred embodiment by providing positive feedback with a resistor from output pin 7 of comparator U1 to input sense pin 2, and adjusting the resistor values accordingly.

Hysteresis in the comparator circuit is also useful for minimizing dependence of the set point signal on line voltage. For a typical choice of the comparator thresholds, the triac-firing time detected by the phase-angle sensing circuit will be very insensitive to the amplitude of the line voltage at the turn-on of the triac, since the rising edge of the ballast input voltage will have a fast rise time, generally less than 100 microseconds. During the falling edge of the ballast input voltage, however, the waveform will typically have a slope closer to that of the sinusoidal line voltage, so that the threshold crossing time may vary with the amplitude of the line voltage. As the turn-off threshold is reduced towards the zero crossing and the maximum-slope point, the dependence of the switching point on line voltage amplitude is substantially reduced.

Figure 9:
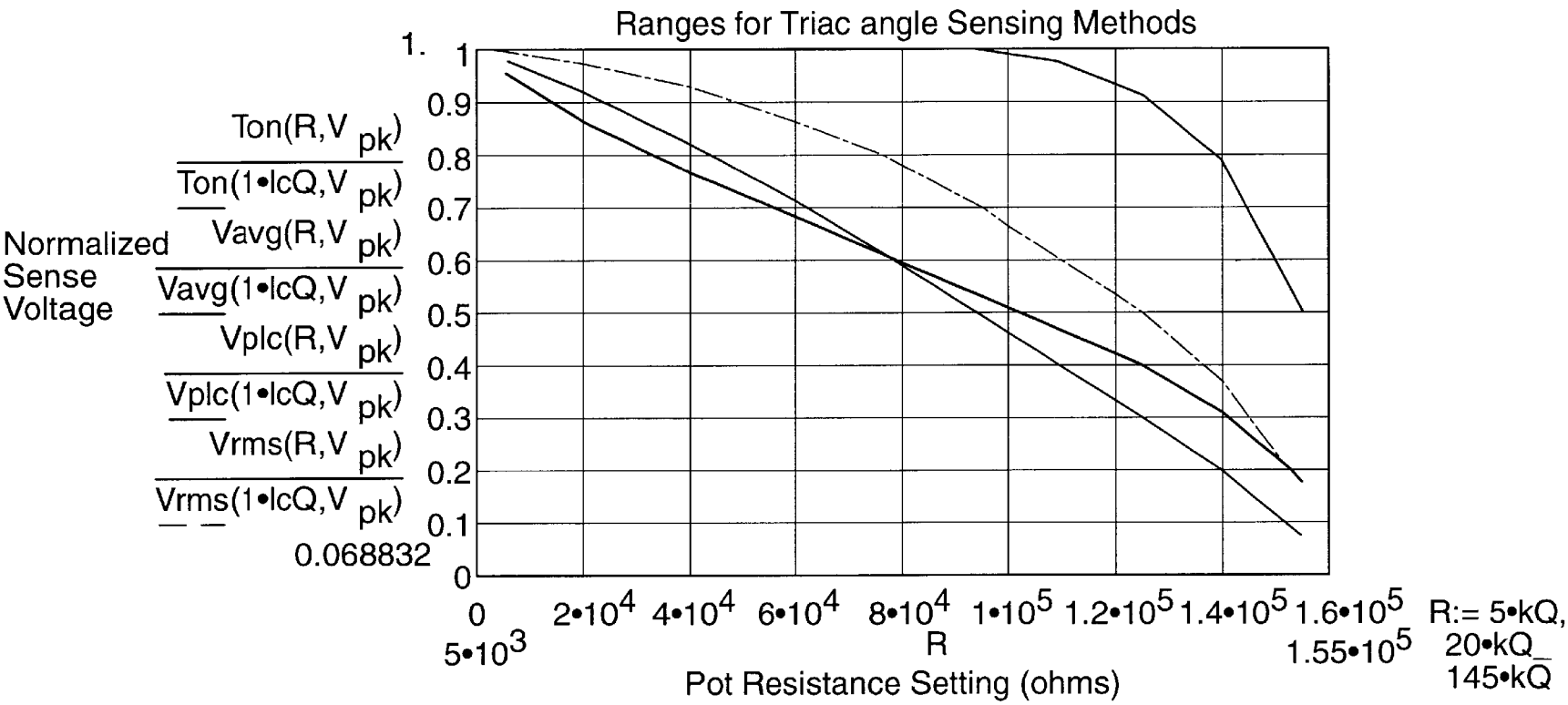
FIGS. 9, 10 and 11 are graphs comparing the response of a sensing circuit in accordance with an embodiment of the invention to the response of prior art sensing circuits.
Figure 10:
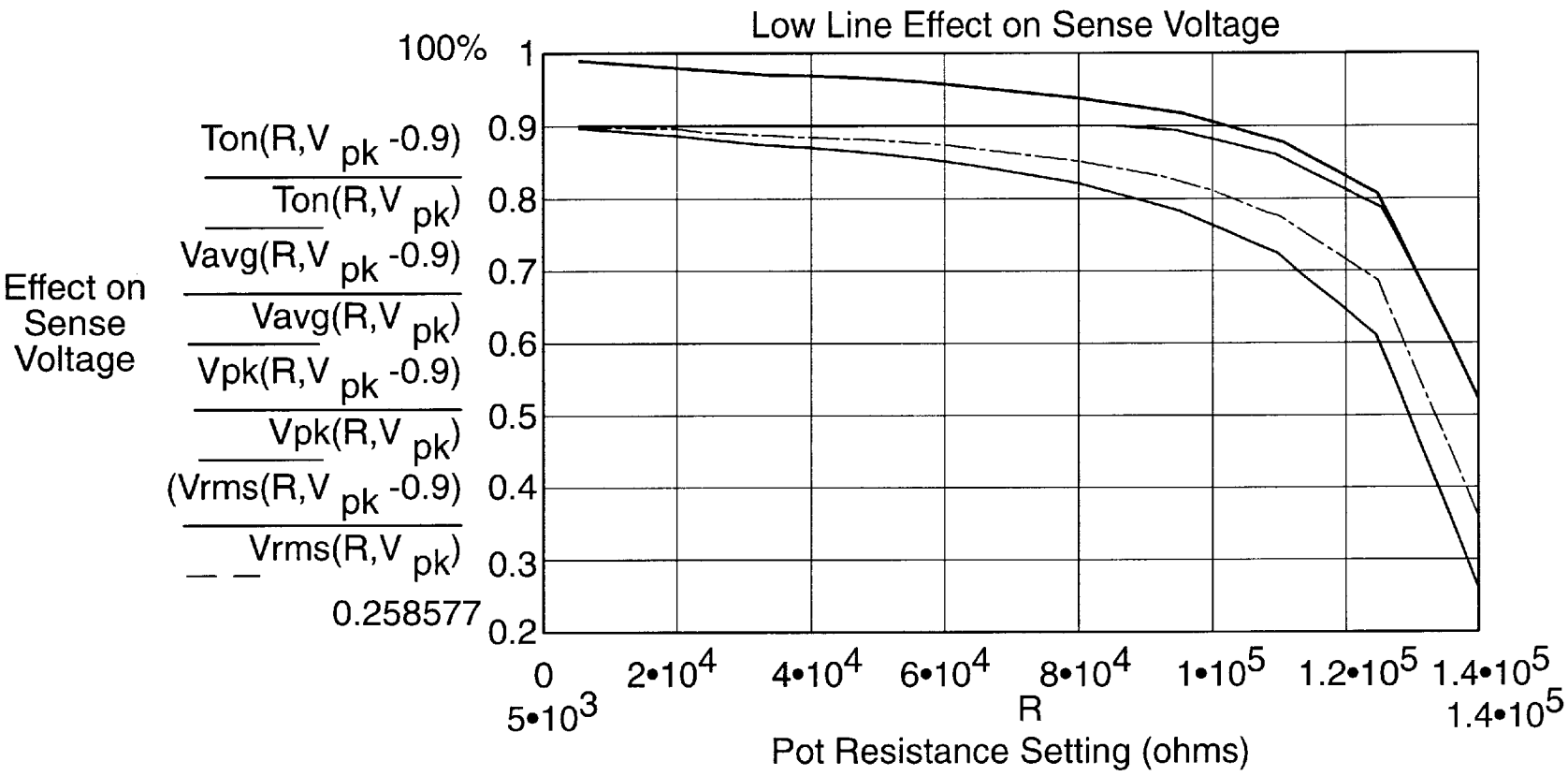
Figure 11:
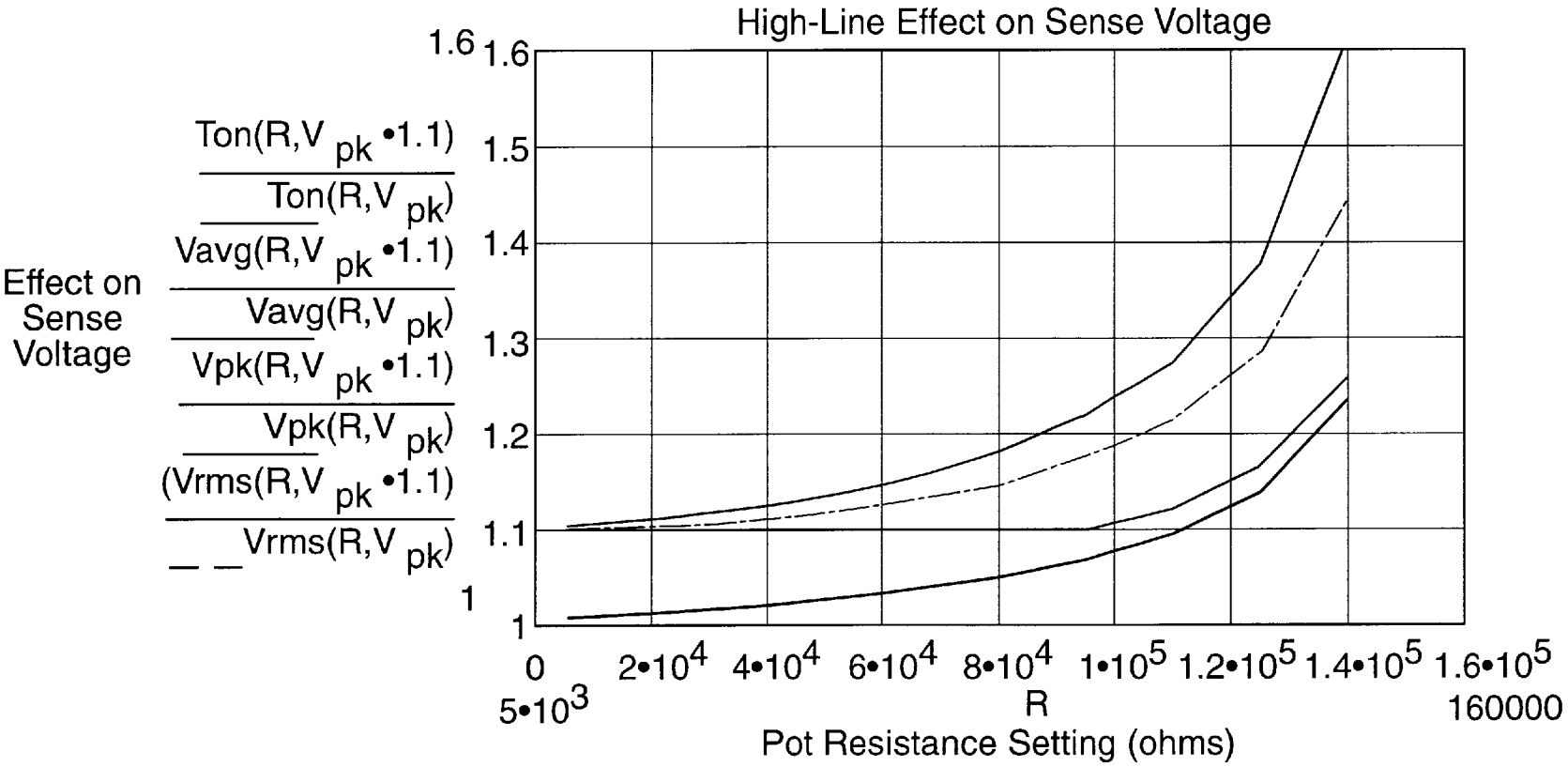

The advantages of the present invention over other prior art triac angle sensing methods are illustrated in FIGS. 9 through 11. FIG. 9 plots set point signal amplitude against the triac dimmer circuit potentiometer value for the four sensed parameters listed on the vertical axis, namely, duty cycle (phase angle), average voltage, peak voltage, and rms voltage. Of these four, it is seen that the duty cycle curve provides the most gradual slope, which translates into a wider mechanical range of dimming control by a user of the dimmer potentiometer. While rms shows similar characteristics, it is a much more difficult parameter to sense. FIG. 9 shows the effect of lowering the line voltage to 90% of its nominal value. The vertical axis represents the factor by which set point signal amplitude is changed at various potentiometer values compared to set point signal amplitude at nominal line voltage. The ideal parameter would be horizontal at 1. FIG. 10 shows that the duty cycle set point signal is significantly less sensitive to line voltage reduction than the other sensed parameters and most closely approximates the ideal. FIG. 11 shows the effect of raising line voltage to 110% of its nominal value and as in FIG. 10 the duty cycle set point signal is significantly less sensitive to this change.

The comparator circuitry of the present invention enables a simple low-cost manner of using an integrated circuit controller to generate the timing delay for preheating the electrodes of the discharge lamp prior to ignition, as is generally needed to achieve good lamp life. The conventional method of charging a capacitor generally requires a large-valued (about 1 uF) discrete capacitor and at least one extra pin on the IC. In accordance with an embodiment of the invention, the preheat delay is generated by counting pulses produced by the comparator, which occur at twice the line frequency of the AC power source. FIG. 8 shows a preheat timer that receives the output of the comparator on the input side of a buffer that isolates the effects of the averaging capacitor C3. The buffer may comprise for example a source follower or a conventional two transistor buffer. It is noted that in this embodiment, the comparator signal can be generated from any input signal irrespective of whether the lamp is driven by a triac dimmer signal or another type of signal.

In one preferred manner of practicing this aspect of the invention, the preheat timer comprises a digital counter. For example a 7-bit counter could provide for programmed preheat times of up to 1.06 seconds with a 60 Hz line frequency by using the most significant bit of the counter as a switching bit for operating a preheat switch such as the MOSFET 82 employed in the prior art circuit illustrated in FIG. 2. A preheat time of 1.28 seconds would be counted if a 50 Hz power source was employed. If the same IC needs to operate with both 50 Hz and 60 Hz lines, then an additional pin of the IC could be used to allow for "programming" of the counter by hard-wiring this extra pin to either ground or to the supply voltage of the IC, thus maintaining the advantage of having no external components (outside of the IC) for generating the preheat timing. As an alternative, a shift register may be employed as a preheat timer, using the comparator output as a clock signal and choosing the size of the register to provide a number of shifts equaling the desired delay time.

In a further preferred embodiment, the sensing circuit may be configured to compensate for changes in line voltage. In this alternative embodiment, the peak of the input voltage, or a DC level associated with the rectified input voltage, is sensed, and a voltage proportional to a detected change in peak voltage is fed to the comparator output. In this embodiment, the set point is made to change in the appropriate direction to compensate for changes in line voltage by reversing the inputs to the comparator, so that the output of the comparator is high when the instantaneous line voltage is below the input threshold level. The set point signal is generated by subtracting the comparator output voltage from a fixed reference voltage.

While the invention has been described with respect to specific embodiments by way of illustration, many modifications and changes will occur to those skilled in the art. It is therefore to be understood that the appended claims are intended to cover all such modifications and changes as fall within the true spirit and scope of the invention.

What is claimed is:

1. A method for controlling a triac dimmable gas discharge lamp ballast, comprising:

sensing a duty cycle of a triac dimmer output waveform;

generating a rectified output waveform from the triac dimmer output waveform;

feeding the rectified output waveform to a comparator;

producing output pulses corresponding in width to the duty cycle of the triac dimmer output waveform;

producing a set point signal having a value corresponding to the sensed duty cycle; and controlling lamp current in response to the set point signal.

2. The method claimed in claim 1, wherein controlling lamp current comprises controlling a frequency of a voltage applied to a resonant load circuit of the ballast.

3. A method for controlling a triac dimmable gas discharge lamp ballast, comprising:

sensing a duty cycle of a triac dimmer output waveform wherein sensing a duty cycle comprises producing square pulses having pulse widths corresponding to the duty cycle of corresponding pulses of the triac dimmer output waveform;

producing a set point signal having a value corresponding to the sensed duty cycle; and controlling lamp current in response to the set point signal.

4. The method claimed in claim 3, wherein producing a set point signal comprises producing an average value of the square pulses.

5. A sensing circuit for a triac dimmable gas discharge lamp ballast, comprising:

a comparator receiving a rectified output waveform of a triac dimmer and producing output pulses corresponding in width to the duty cycle of the waveform; and a low pass filter averaging the values of the pulses produced by the comparator to produce a set point signal representing a target dimming level of the lamp.

6. The sensing circuit claimed in claim 5, wherein the comparator has a turn-on threshold of approximately 25% to 50% of nominal peak line voltage.

7. The sensing circuit claimed in claim 5, wherein the comparator is configured to have hysteresis with a turn-on threshold of approximately 25% to 50% of nominal peak line voltage and a turn-off threshold of approximately 10% of nominal peak line voltage.

8. The sensing circuit claimed in claim 5, further comprising a summing voltage divider for providing a full wave rectified triac dimmer output waveform to the comparator.

9. The sensing circuit claimed in claim 5, wherein the comparator receives a half wave rectified triac dimmer output waveform.

10. A preheat timing circuit for a triac dimmable gas discharge lamp ballast, comprising:

a comparator receiving a rectified input voltage waveform and producing output pulses; and a timer receiving the output of the comparator and being operative of a preheat switch of the gas discharge lamp ballast after receiving a predetermined number of output pulses.

11. The preheat timing circuit claimed in claim 10, wherein the timer comprises a shift register receiving the output of the comparator as a clock signal.

12. The preheat timing circuit claimed in claim 10, wherein the timer comprises a pulse counter for counting pulses of the output of the comparator.

13. A dimmable gas discharge lamp ballast, comprising:

an a.c. to d.c. converter receiving an output waveform of a triac dimmer;

a lamp drive section powered by the a.c. to d.c. converter and driving a gas discharge lamp with an a.c. signal;

a sensing-circuit producing a set point signal in accordance with a duty cycle of the output waveform of the triac dimmer, wherein the sensing circuit comprises a comparator; and a clamping circuit controlling lamp current in response to the set point signal.

14. The dimmable gas discharge lamp ballast claimed in claim 13, wherein the a.c. to d.c. converter comprises a rectifier bridge having an energy storage capacitor coupled across output terminals thereof.

15. A dimmable gas discharge lamp ballast, comprising:

an a.c. to d.c. converter receiving an output waveform of a triac dimmer;

a lamp drive section powered by the a.c. to d.c. converter and driving a gas discharge lamp with an a.c. signal;

a sensing circuit producing a set point signal in accordance with a duty cycle of the output waveform of the triac dimmer; and a clamping circuit controlling lamp current in response to the set point signal;

wherein the lamp drive section comprises:

a resonant load circuit including a resonant inductance and a resonant capacitance for coupling a.c. current to the gas discharge lamp;

a self-oscillating complementary converter circuit for inducing a.c. current in the resonant load circuit, the converter circuit including a pair of switches serially connected between a d.c. bus and a reference bus, respective reference nodes of the switches being connected at a common node through which said a.c. current flows, and respective control nodes of said switches being substantially directly interconnected; and a gate drive circuit for controlling said switches, including a drive winding and an inductor serially connected between the common node and the control nodes, the drive winding being mutually coupled to the resonant inductance for sensing voltage therein.

16. The dimmable gas discharge lamp ballast claimed in claim 15, wherein the clamping circuit comprises:

an error amplifier receiving the set point signal and a lamp current feedback signal and providing an error signal;

an impedance controlled in response to the error signal; and a diode bridge network allowing the impedance to conduct current in either direction through the inductor.

17. The dimmable gas discharge lamp ballast claimed in claim 16, wherein the clamping circuit is directly coupled across terminals of the inductor.

18. The dimmable gas discharge lamp ballast claimed in claim 15, wherein the clamping circuit comprises:

an error amplifier receiving the set point signal and a lamp current feedback signal and providing an error signal;

an impedance controlled in response to the error signal; a diode bridge network allowing the impedance to conduct current in either direction through a control winding mutually coupled to the inductor to control the voltage across the inductor.

19. A dimmable gas discharge lamp ballast, comprising:

an a.c. to d.c. converter receiving an output waveform of a triac dimmer;

a lamp drive section powered by the a.c. to d.c. converter and driving a gas discharge lamp with an a.c. signal;

a sensing circuit producing a set point signal in accordance with a duty cycle of the output waveform of the triac dimmer; and a clamping circuit controlling lamp current in response to the set point signal;

wherein the sensing circuit comprises:

a sensing comparator receiving a rectified output waveform of the triac dimmer and producing output pulses corresponding in width to the duty cycle of the waveform; and a low pass filter averaging the values of the pulses produced by the comparator to produce the set point signal.

20. The dimmable gas discharge lamp ballast claimed in claim 19, further comprising a preheat timing circuit comprising a timer receiving the output of the sensing comparator and operative of a preheat switch of the gas discharge lamp ballast after receiving a predetermined number of output pulses.

* * * * *